United States Patent [19]
Boe
[11] 4,230,226
[45] Oct. 28, 1980

[54] EMERGENCY PRESCRIPTION KIT FOR TRAVELERS

[76] Inventor: Eldon L. Boe, 6455 LaJolla Blvd. 103, La Jolla, Calif. 92037

[21] Appl. No.: 932,029

[22] Filed: Aug. 8, 1978

[51] Int. Cl.³ ..... B65D 1/36; B65D 71/00; B65D 75/54

[52] U.S. Cl. ..... 206/570; 206/561; 190/41 Z

[58] Field of Search ..... 206/570, 561; 190/41 Z

[56] References Cited

U.S. PATENT DOCUMENTS

| | | | |
|---|---|---|---|
| 1,487,014 | 3/1924 | Davis | 206/570 |
| 1,618,955 | 2/1927 | Gotisar | 190/412 |
| 2,159,904 | 5/1939 | McDonough | 206/570 |
| 3,627,122 | 12/1971 | Garbe | 206/561 |
| 3,653,567 | 4/1972 | Selvaggio | 206/570 |

FOREIGN PATENT DOCUMENTS

| | | | |
|---|---|---|---|
| 556418 | 10/1943 | United Kingdom | 224/45 A |

*Primary Examiner*—George E. Lowrance
*Attorney, Agent, or Firm*—Knox & Knox

[57] ABSTRACT

A prescription kit for travelers somewhat suggestive of a doctor's bag for psychological purposes with a flat base and internally compartmented to hold containers, ordinarily vials, in upright position and clearly visible when the bag-like case is opened, the vials having caps with insignia thereon to indicate their drug contents which will be a largely standardized complement of drugs likely to be needed by travelers but with provision made for some of the drugs to be specifically prescribed if necessary. The kit is designed to be sold only by pharmacists and the drugs, even when the standardized complement of drugs is used, will still be by a physician's prescription, the standardization or near standardization of the drugs representing a great time saver for the physician who can often prescribe the full complement as such, the manufacturer's description, suggested dosage and warnings as well as a physician's directions being provided in printed pamphlets provided in the kit.

2 Claims, 4 Drawing Figures

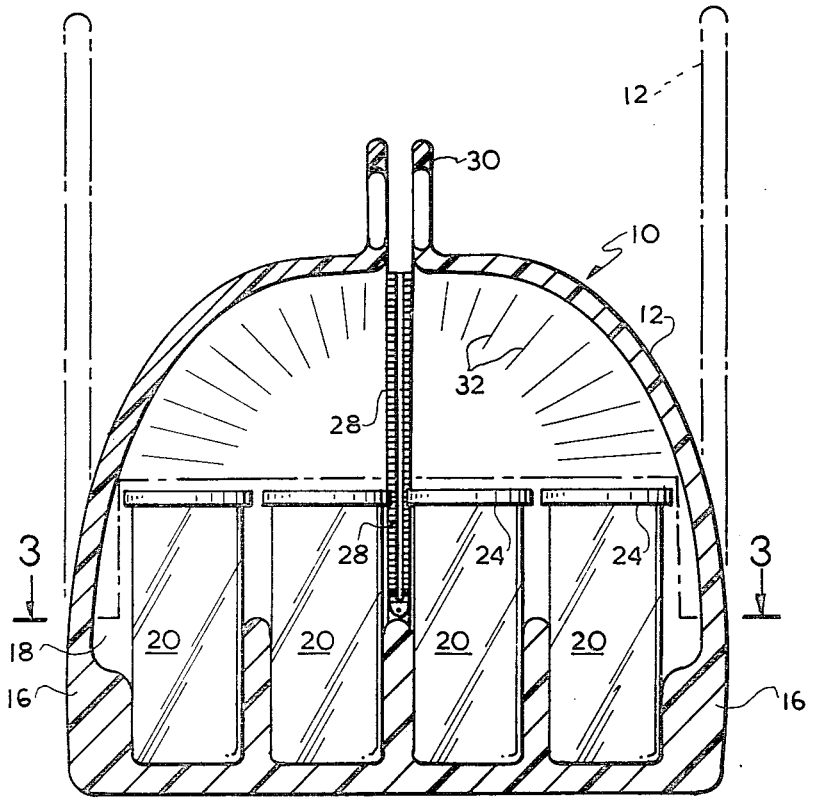
FIG. 1
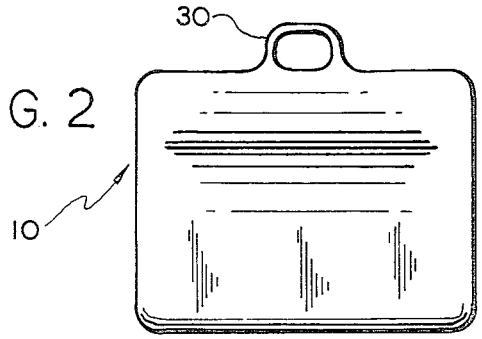
FIG. 2
FIG. 3
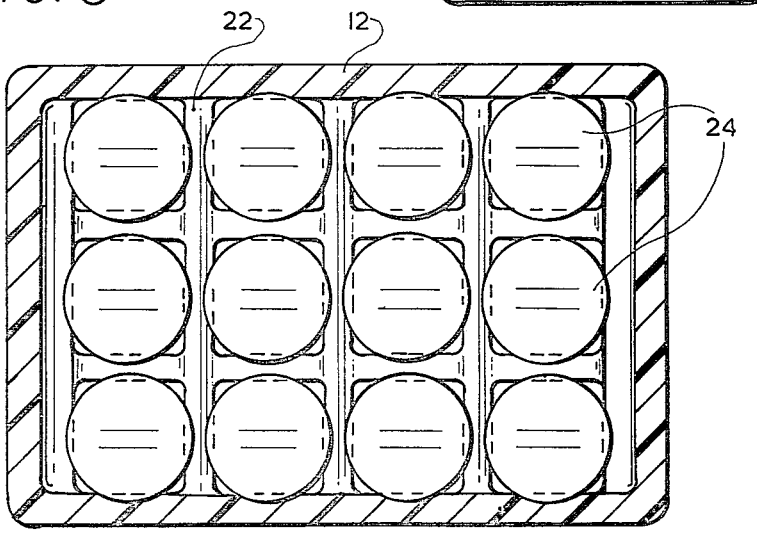
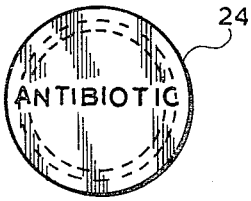
FIG. 4

EMERGENCY PRESCRIPTION KIT FOR TRAVELERS

BACKGROUND OF THE INVENTION

Travelers are notoriously susceptible to nervousness and insomina, respiratory and intestinal infections, colds and nausea and like ailments and a great number of people regularly request their physicians to prescribe drugs which they can purchase before the start of their trips especially when foreign countries are to be visted. This results very often in a hurried and sometimes inadequate prescribing of drugs and is time consuming for the physician and the pharmacist and the prospective traveler may also be inconvenienced and nearly always be confronted with a awkward assemblage of variously sized bottles and/or packets and even inadequate or misplaced information on symptoms and dosages which may be critical. There is a need, therefore, for an emergency kit containing a complement of drugs which although prescribed in toto, or slightly changed, by a physician, will provide the traveler with a conveniently packaged supply of the drugs he may need, all in one place and with the necessary information as to their use.

SUMMARY OF THE INVENTION

As claimed, the instant invention meets the immediately abovementioned need and is characterized by a carrying case which is form-retaining but slightly flexible to make it suitable for packing in baggage and compartmentized to support a considerable number of vials or the like in upright position and easily distinguished, with a complement of prescribed drugs in the vials accompanied by the actual written prescription and printed information, all arranged to minimize likelihood of displacement, loss and damage, with maximum convenience for the physical, pharmacist and the user.

BRIEF DESCRIPTION OF THE DRAWING

FIG. 1 is a slightly diagrammatic cross-sectional view of the carrying case, closed and with capped containers installed in the compartmented base.

FIG. 2 is a side elevational view of the case.

FIG. 3 is a horizontal sectional view taken on the stepped section line 3—3 in FIG. 1.

FIG. 4 is an enlarged plan view of a container cap with the container indicated in dash line.

DETAILED DESCRIPTION OF A PREFERRED EMBODIMENT

Referring now to the drawing wherein like numerals refer to similar or identical parts and portions throughout the different views, the carrying case generally indicated by the numeral 10 is shown as of unitary construction, preferably of somewhat flexible imitation leather plastic so as to be more readily packed in suitcases and the like. For psychological reasons the carrying case should also be suggestive of the traditional doctor's bag. Although slightly flexible and presumably always of light weight with walls 12 and a base 14 of reasonably thin plastic, the case must be substantially form-retaining and is shown as having thickened wall portions 16 adjacent the base 14 to provide the necessary stability.

Immediately above the thickened wall portions are pockets 18 wherein may be stored written prescriptions or copies thereof and pamphlets giving information relating to symptons, care, and dosage of drugs as well as manufacturer's detailed therapeutic descriptions, and in certain cases information regarding importation of certain drugs in some countries. It is a feature of this invention that all such information is originally stored in said pockets 18 adjacent to the actual related drugs in the containers 20, where this important information is not likely to be misplaced, lost or damaged.

The containers 20 may be of vial type and the base 14 is provided with a grid 22 shown as integral with said base 14 and compartmentizing the same into a considerable number of spaces or sockets into which the containers are removably pressed and then retained preferably in upright position as shown. Each container has a cap 24 with indicia 26 thereon to indicate the contents thereof so that even in an emergency the user or a friend can quickly and unmistakeably find the desired drug. Obviously more detailed directions as to use and dosage will ordinarily be applied to or inserted in the containers.

The carrying case has a wide top opening capability to expose all the containers 20 to view and this is accomplished as shown by employing a zipper or similar fastener 28 in an opening extending down to adjacent the level of the top of the grid 22. Handles 30, also integral with the rest of the carrying case 10 complete this structure, again preferably configured to suggest those of a doctor's bag, and it is a feature of the carrying case as shown that opposing upper portions 32 of the case are collapsed inwardly of the case, when the same is closed, over the tops of the capped containers 20 to retain the containers in place.

Having described my invention, I claim:

1. An emergency presecription kit for travelers comprising and characterized by:

(a) a carrying case of tough, waterproof material, said case having a base, flexible side walls with a pair of handles entirely unitary with said walls, said case having a top opening positively closed by a zipper;

(b) said case being internally compartmented by a single layer grid holding a plurality of containers in spatially ordered arrangement on said base;

(c) said walls having form-retaining thicker lower portion with internal pockets formed thereabove adjacent to said containers with drug informational pamphlets therein; and (d) said containers having corresponding drugs therein and container contents-identifying means visible through said top opening, the majority at least of said drugs being a standardized multiple prescription which can be professionally and quickly written en block by a user's physician as a necessary complement of drugs for a traveler, whereby a user-traveler's anticipated emergency medical needs may be met and the physician's time is reduced to that necessary for any additions and deletions of drugs contra-indicated for a particular individual's use.

2. A prescription kit according to claim 1 wherein said case and said containers are proportioned so that when said top opening is closed opposing portions (32) of the case are collapsed inwardly of the case and over said containers holding the same in place.

* * * * *